US008678535B2

(12) United States Patent
Beier et al.

(10) Patent No.: US 8,678,535 B2
(45) Date of Patent: Mar. 25, 2014

(54) APPARATUS FOR PRINTING SURFACES HAVING A PLURALITY OF MOVABLE PRINT HEADS AND SYSTEM HAVING THE APPARATUS

(75) Inventors: Bernard Beier, Ladenburg (DE); Heiner Pitz, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/432,235

(22) Filed: Mar. 28, 2012

(65) Prior Publication Data

US 2012/0249679 A1 Oct. 4, 2012

(30) Foreign Application Priority Data

Mar. 28, 2011 (DE) ..... 10 2011 015 277

(51) Int. Cl.
*B41J 2/25* (2006.01)

(52) U.S. Cl.
USPC ..... 347/14

(58) Field of Classification Search
USPC ..... 347/14, 40, 43
See application file for complete search history.

(56) References Cited

U.S. PATENT DOCUMENTS

| | | | |
|---|---|---|---|
| 6,096,132 | A | 8/2000 | Kaiba et al. |
| 2005/0115421 | A1 | 6/2005 | Lyons |
| 2005/0238794 | A1 | 10/2005 | Yang et al. |
| 2011/0262622 | A1 | 10/2011 | Herre et al. |

FOREIGN PATENT DOCUMENTS

| | | | |
|---|---|---|---|
| DE | 41 20 293 | A1 | 2/1992 |
| DE | 10 2008 053 178 | A1 | 5/2010 |
| EP | 0 970 811 | A1 | 1/2000 |
| EP | 1 992 494 | A2 | 11/2008 |

OTHER PUBLICATIONS

German Patent and Trademark Office Search Report, Dated Jan. 19, 2012.

*Primary Examiner* — Lamson Nguyen
(74) *Attorney, Agent, or Firm* — Laurence A. Greenberg; Werner H. Stemer; Ralph E. Locher

(57) ABSTRACT

An apparatus for printing surfaces, for example of three-dimensionally shaped vehicle body parts, includes movable print heads having actuable, preferably inkjet, nozzles, and at least one printing position and one parking position into which the print heads can be moved or rotated. At least one first and one second print head have mutually different nozzle configurations, sizes or shapes. In a first mode, the first print head is in a printing position and the second print head is in a parking position, and in a second mode, the first print head is in a parking position and the second print head is in a printing position. The print heads can be on a rotation apparatus which can be on a robot arm. Surfaces of any shape, having curvatures and/or undercuts, can be printed in one or multiple colors (in image terms). A system having the apparatus is also provided.

11 Claims, 2 Drawing Sheets

APPARATUS FOR PRINTING SURFACES HAVING A PLURALITY OF MOVABLE PRINT HEADS AND SYSTEM HAVING THE APPARATUS

CROSS-REFERENCE TO RELATED APPLICATION

This application claims the priority, under 35 U.S.C. §119, of German Patent Application DE 10 2011 015 277.6, filed Mar. 28, 2011; the prior application is herewith incorporated by reference in its entirety.

BACKGROUND OF THE INVENTION

Field of the Invention

The present invention relates to an apparatus for printing surfaces, including a plurality of movable print heads each including a plurality of individually actuable nozzles, at least one printing position and at least one parking position for the print heads, in which the print heads are movable into the respective positions. The invention also relates to a system having the apparatus.

So-called inkjet printers having movable inkjet print heads are known from the prior art. Those inkjet printers are used, for example, in the home and office areas, in order to print paper with multiple colors. In that case, a separate print head is available for each printing color. The individual print heads and/or their respective nozzle configurations are identical. When multiple-color prints are produced, the heads are moved at the same time relative to the paper and in the process eject ink droplets at the same time, that is to say all of the heads are active. After the printing, all of the print heads are moved into a common parking position, in which usually cleaning of the heads also takes place, that is to say all of the heads are inactive. Moreover, industrial applications having inkjet heads are also known, in which the heads are accommodated, for example, on large X-Y frames and are used to print large area paper sheets or material webs. In addition, it is also already known to attach inkjet heads to robot arms which can be moved freely in three dimensions, in order for it to be possible in that way to print not only flat but also curved surfaces (as desired), for example body parts of vehicles. During the printing of body parts, however, spray nozzles are usually used, that is to say the parts are loaded with a spray mist. In contrast to inkjet heads, spray nozzles of that type cannot eject individual droplets as a result of individual control pulses. It is therefore disproportionately more difficult to generate (locally multiple-color) image information (in particular, on the basis of pixels) and instead, for example, a body component is usually painted only with one color or with multiple colors (that is to say globally with multiple colors, but locally only with one color). In the following text, examples from the prior art will be described.

German Patent DE 41 20 293 C2 describes a rotatable inkjet head (having individually actuable nozzles, for example according to the piezoelectric principle) on an X-Y frame, with which curves of any desired profile can be printed with a consistent coat thickness. A corresponding number of heads which are, however, identical can also be provided for multiple-color printing (yellow, cyan, magenta, black).

German Patent Application DE 10 2008 053 178 A1, corresponding to U.S. Patent Application Publication No. US 2011/0262622 A1, describes a coating device, for example for body parts of vehicles, with an inkjet head (having individually actuable nozzles, for example according to the piezoelectric principle) being accommodated on a robot arm and therefore making it possible to move it into any desired position and along any desired tracks. The print head can have a part which ejects the coating medium continuously and a part which ejects it in droplets. The print head can also have nozzle openings of different size, for example nozzle rows with large nozzles and nozzle rows with small nozzles. A plurality of identical print heads can also be provided which can be pivoted relative to one another, in order to achieve an improved adaptation to the surface of a curved component (see FIG. 22 of German Patent Application DE 10 2008 053 178 A1, corresponding to U.S. Patent Application Publication No. US 2011/0262622 A1).

European Patent Application EP 970 811 A1, corresponding to U.S. Pat. No. 6,096,132, describes an automatic painting device for vehicles, which automatic painting device has spray pistols for four colors. The four identical spray pistols are accommodated on an X-Y frame in such a way that they can have their respective spacing in the Z-direction from the vehicle surface changed individually.

In the prior art, identical heads, that is to say identical nozzle configurations, are therefore always used if a plurality of heads are used. Moreover, all of the heads are always active at the same time and print, or are inactive and do not print. The adaptation to the surface of a curved component takes place only by guiding the head to the component and guiding it along the component while maintaining the spacing, or by relative positioning of a plurality of heads with respect to one another. The printing of extremely curved surfaces (with small radii of curvature) and, in particular, of surfaces with so-called undercuts (with surface sections which project freely and impede, for example, the free access to other surface sections) can therefore still lead to problems.

A further problem can result from the dimensions of the print head. With an inkjet print head having a length L at a given working spacing A from the surface to be printed and a given tolerance TA of the working spacing, only a surface with a minimum radius of curvature Rmin can be printed due to the geometric conditions (L and A: see FIG. 1).

EXAMPLES

| L [mm] | A [mm] | TA [mm] | Rmin [mm] |
|---|---|---|---|
| 10 | 10 | 0.5 | 25.3 |
| 50 | 10 | 0.5 | 625.3 |
| 100 | 10 | 0.5 | 2500.3 |
| 10 | 10 | 1 | 13.0 |
| 50 | 10 | 1 | 313.0 |
| 100 | 10 | 1 | 1250.5 |
| 10 | 10 | 2 | 7.3 |
| 50 | 10 | 2 | 157.3 |
| 100 | 10 | 2 | 626 |
| 10 | 10 | 3 | 5.7 |
| 50 | 10 | 3 | 105.7 |
| 100 | 10 | 3 | 418.2 |

It can be seen from the table that Rmin increases as L increases and decreases as TA increases. Theoretically, that is to say purely from the geometric consideration, Rmin is independent of A. A has therefore been estimated with an appropriate value of 10 mm. In practice, however, Rmin is actually dependent on A after all because it cannot be expected that a print head can achieve the same print resolution at every spacing A from the surface, and therefore Rmin decreases as A increases (at a given print resolution).

SUMMARY OF THE INVENTION

It is accordingly an object of the invention to provide an improved apparatus for printing surfaces having a plurality of movable print heads and a system having the apparatus, which overcome the hereinafore-mentioned disadvantages of the heretofore-known apparatuses and systems of this general type and which permit or provide favorable preconditions for the printing of surfaces which are shaped in any desired manner and, in particular, are curved to as pronounced an extent as desired.

With the foregoing and other objects in view there is provided, in accordance with the invention, an apparatus for printing surfaces. The apparatus comprises at least one printing position and at least one parking position, a plurality of movable print heads configured to be moved into the at least one printing position and into the at least one parking position, each of the movable print heads having a plurality of individually actuable nozzles, the movable print heads including at least one first print head and at least one second print head having mutually different nozzle configurations, the at least one first print head being disposed in a printing position and the at least one second print head being disposed in a parking position, in a first mode, and the at least one first print head being disposed in a parking position and the at least one second print head being disposed in a printing position, in a second mode.

The surfaces to be printed are preferably surfaces which are shaped in any desired manner and, in particular, are curved to as pronounced an extent as desired. They can also have undercuts. As a result of the selection of the different nozzle configurations, according to the invention the precondition is provided to print both, for example, flat surface sections and (severely) curved surface sections. In an advantageous way, surfaces with surface sections which are different in terms of their respective topology can also be printed. In each case that nozzle configuration is used locally in this case which is provided for flat, curved or severely curved sections or for sections with undercuts. The apparatus therefore permits a change between heads, that is to say it can be defined which head with which nozzle configuration is to be active and which is to be inactive.

The heads can preferably be moved freely three-dimensionally and can therefore advantageously be guided onto surfaces (surface sections) which are shaped in any desired manner and can be guided along the surfaces (surface sections) on tracks which are shaped in any desired manner. A predefined working spacing from surfaces which are shaped in any desired manner can also be maintained.

The nozzles are preferably inkjet nozzles which produce droplets in a one-dimensional or two-dimensional configuration. The nozzles are preferably not nozzles which generate spray mist or are different from nozzles of that type.

The parking positions can be identical for the different print heads. As an alternative, a separate parking position can also be provided for each print head. Corresponding conditions apply to the printing position/positions.

In accordance with another feature of the apparatus of the invention which is advantageous and therefore preferred for the rapid printing of large, flat surfaces and the slow printing of small, curved surfaces, the nozzle configurations which are different from one another differ in terms of their respective number of nozzles, with the number of nozzles of the nozzle configuration of the first print head being lower than the number of nozzles of the nozzle configuration of the second print head. For example, one print head can have more than ten nozzles and one print head can have less than ten nozzles. In this consideration, the expressions "rapid" and "slow" do not relate to the relative speed between the substrate and the nozzles, but rather to the printed area per unit time—that is to say, for example, using the unit square meters per minute.

In accordance with a further feature of the apparatus of the invention which is advantageous and therefore preferred for the rapid printing of large, flat surfaces and the slow printing of small, curved surfaces, the nozzle configurations which are different from one another differ in terms of their respective spatial configuration of the nozzles. For example, one print head can have a noncurved, linear nozzle configuration and one print head can have a curved (curvilinear), linear nozzle configuration. Furthermore, the nozzle configuration can be hook-shaped and can therefore be used for printing edges or bends.

In accordance with an added feature of the apparatus of the invention which is advantageous and therefore preferred for changing the print heads, at least one first and one second print head are disposed on a common transport apparatus which moves the print heads into the respective positions. Through the use of the transport apparatus, an active print head can be moved into a parking position and an inactive print head can be moved into a printing position, with the activity states changing. The transport apparatus is preferably a rotation apparatus which permits the individual print heads that are accommodated on it to have their respective position (and activity states) changed by rotation. As an alternative, a circulating belt or a (for example, electric) linear drive can be provided.

In accordance with a concomitant feature of the apparatus of the invention which is advantageous and therefore preferred for free, spatial positioning and moving, the common transport apparatus is disposed on a controllable and multiple-member robot arm or an X-Y-Z frame, with X, Y and Z denoting the three spatial directions, in which the transport apparatus can be moved independently of one another through the use of the frame.

In the following text, the invention per se and structurally and/or functionally advantageous developments of the invention will be described in greater detail with reference to the associated drawings and using at least one preferred exemplary embodiment. Elements which correspond to one another are provided in each case with the same designations in the drawings.

Other features which are considered as characteristic for the invention are set forth in the appended claims.

Although the invention is illustrated and described herein as embodied in an apparatus for printing surfaces having a plurality of movable print heads and a system having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
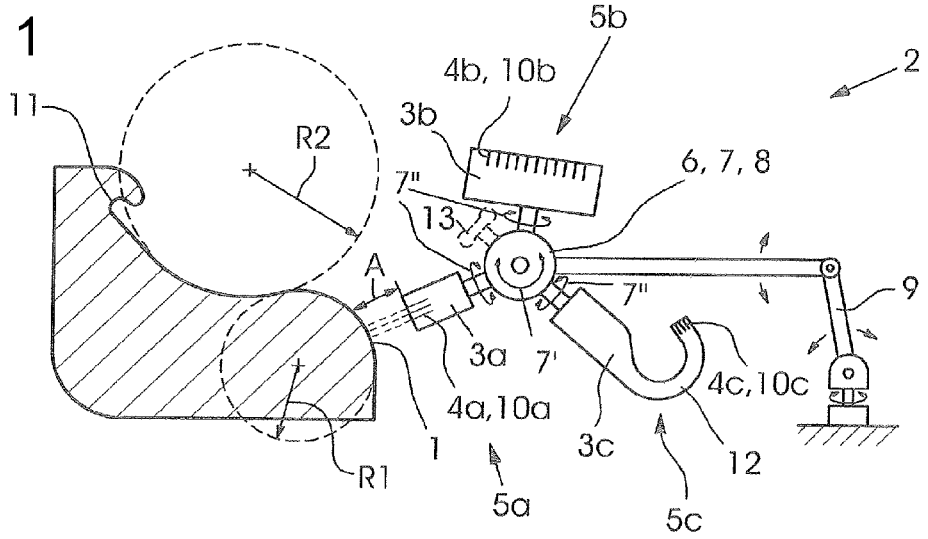
FIG. 1 is a diagrammatic, partly sectional, side-elevational view of one preferred exemplary embodiment of an apparatus according to the invention for printing surfaces.

Referring now to the figures of the drawings in detail and first, particularly, to FIG. 1 thereof, there is seen a diagrammatic side view of one preferred exemplary embodiment of an apparatus 2 according to the invention for printing surfaces 1 that are shaped in any desired manner (which are referred to in short as 3D surfaces). As shown in FIG. 1, the surface 1 has at least one curvature. The surface can, for example, be a vehicle body part to be painted. It is possible, by way of the apparatus 2 according to the invention, to paint surfaces which are curved or shaped in any desired manner with one color or multiple colors, or to provide them with a multiple-color information item (image, pattern or text).

The apparatus 2 has a plurality of movable print heads 3*a* to 3*c* of different geometry which in each case include a plurality of individually actuable nozzles 4*a* to 4*c*. In the illustrated exemplary embodiment, three print heads are shown by way of example. Each of the three print heads can be moved into an (active) printing position 5*a* or an (inactive) parking position 5*b* or 5*c*. The printing position 5*a* is a position in which the print head 3*a* is disposed within a tolerance TA at a working spacing A from the surface 1. If so-called inkjet heads are used, the working spacing can be limited, for example, by their operating range, that is to say the substantially unimpeded range of the ink droplets. The working spacing can also be limited by a minimum spacing, for example in order to avoid collision. In FIG. 1, the print head 3*a* is in the printing position 5*a*, whereas the two print heads 3*b* and 3*c* are in respective parking positions 5*b* and 5*c*. The parking position is a position, in which the print head does not print and instead can be cleaned, for example. The cleaning of the inactive print head can take place while the active print head is printing.

As is shown in FIG. 1, the three print heads 3*a-c* are disposed on a common transport apparatus 6 which is configured as a rotation apparatus 7 (see arrow 7') and moves or rotates the print heads 3*a-c* into the respective positions 5*a-c*. As an alternative, more than three or only two print heads can be provided. Each individual print head 3*a-c* can in turn be accommodated rotatably on the rotation apparatus 7 (see arrow 7").

A rotation 7' through 120° counter to the clockwise direction moves the first (active) print head 3*a* out of the printing position 5*a* into the parking position 5*c* and moves the second (inactive) print head 3*b* out of the parking position 5*b* into the printing position 5*a* (the second print head then becomes active and the first print head becomes inactive). In this case, the third print head 3*c* changes between the two parking positions 5*c* and 5*b*. As shown, the rotation apparatus 7 can have a rotatable, central carrier 8 for the number of print heads. The rotation can take place through the use of an electric motor or pneumatically. A rotation which is only back and forth can also be provided instead of a rotation through 360° or more.

The use of the rotation apparatus permits rapid and precise changes to be used between the respective print heads, in particular in conjunction with rapid control/regulation which is provided for the change of the heads and the adapted change of the image data. The respective position of the nozzles 4*a-c* of the print heads 3*a-c* is selected in such a way that, during a change of the active print head, no disruptive effects are produced in the printing image during the image transition, that is to say the printed image of the first print head seamlessly follows the printed image of the second print head and vice versa.

Each individual print head 3*a-c* can have nozzles 4*a-c* for different colors, paints or inks, in particular for so-called CMYK printing (cyan, magenta, yellow, black). As an alternative, each individual print head 3*a-c* can also be constructed from a plurality, preferably four, of partial heads each of which print only one color. The color space which can be reached by the image setting can be extended, for example by 6-color printing (CMYK, light cyan and light magenta) and by other color systems. In particular, the color space which can be reached can be extended by the additional use of white colors, paints or inks.

It can also be provided that a hydrostatic compensation mechanism for keeping the ink printing constant in the line system of the inkjet heads (or the respective ink meniscus at the outlet openings of the nozzles) forms a unit together with the print head. That unit is accordingly moved in its entirety during the change from the printing position to the parking position.

In a first mode, the first print head 3*a* is disposed in a printing position 5*a* and the second print head 3*b* is disposed in a parking position 5*b*. In a second mode, the first print head 3*a* is disposed in a parking position 5*b* or 5*c* and the second print head 3*b* is disposed in a printing position 5*a*. As an alternative, it is also possible to move two print heads at the same time into the printing position and to switch over from one to the other print head, in order to generate image transitions without disruptive effects in this way. In this case, a third head remains in a parking position.

In the respective parking position 5*b* or 5*c*, the print heads 3*a-c* can remain fastened to the transport apparatus or can be released from the latter and deposited or stored, for example. The ink supply for the print heads preferably remains connected to the transport apparatus during the depositing or storage of print heads.

FIG. 1 also shows that the common transport apparatus 6 is disposed on a controllable and multiple-member robot arm 9. Through the use of the robot arm, the transport apparatus including the print heads 3*a-c* can be positioned relative to the surface 1 and can be guided along the latter for printing, that is to say can be moved relative to the surface. The robot arm allows any desired movements to be carried out and therefore any desired contours to be followed at the working spacing A (within the tolerance TA). A conventional robot arm or else a flexible arm (for example, a so-called bionic handling assistant which is available from the company Festo in Esslingen, Germany) can be used. As an alternative, the transport apparatus can be disposed on an X-Y-Z frame.

The print heads 3*a-c* which are shown by way of example in the figure in each case include a plurality of individually actuable nozzles 4*a-c*. The print heads are preferably so-called inkjet heads, preferably operating on the basis of piezoelectrically activatable nozzles. It can also be provided that, in addition to the inkjet heads 3*a-c*, at least one head which produces a spray mist (that is to say, a head without a plurality of individually actuable nozzles) is provided on the transport apparatus 6, which head is used during large area, single-color painting. Furthermore, it is also possible to use so-called "continuous wave" systems, so-called "valve-jet"

printing systems or so-called "bubble-jet" systems in a manner according to the invention.

The print heads 3*a-c*, which are shown by way of example in FIG. 1, have nozzle configurations 10*a-c* which are different from one another. The nozzle configurations which are different from one another differ in terms of their respective number of nozzles. For example, the number of nozzles 4*a* of the nozzle configuration 10*a* of the first print head 3*a* is lower than the number of nozzles 4*b* of the nozzle configuration 10*b* of the second print head 3*b*. The first print head has only a few individually actuable nozzles. In contrast, the second print head has many individually actuable nozzles. The first print head is therefore preferably suitable for the (slow) printing of surfaces 1 with small radii of curvature R1, and the second print head is therefore preferably suitable for the (rapid) printing of surfaces with large radii of curvature R2 or flat surfaces. As shown, the surface can have both convex and concave sections. The small print head 3*a* is suitable, in particular, for printing concave sections with a small radius of curvature. According to the invention, depending on the topology of the surface segment to be printed, a suitable print head 3*a-c* can therefore be moved into the printing position 5*a* near the segment.

Figure 2:
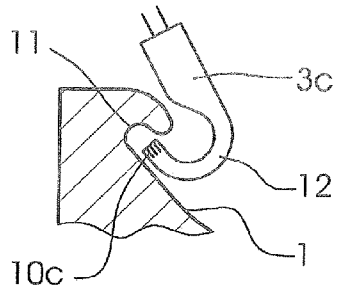
FIG. 2 is a fragmentary, partly sectional, side-elevational view showing a situation during the printing of undercuts.

FIG. 1 also shows a section of the surface 1 to be printed with a so-called undercut 11 which can be formed, for example, by a groove. In the case of a body part, an undercut of this type can be provided, for example, by a door handle or at outer edges which are bent over. Printing of this section can take place only by way of a very small print head 3*c*. The third print head 3*c* is constructed specifically for printing undercuts of this type. To this end, the third print head has a very small nozzle configuration 10*c*. That nozzle configuration is additionally attached to a bent section 12 of the print head. The section 12 allows the nozzle configuration to be guided into the interior of the undercut. A situation of this type is shown by way of example in FIG. 2.

The different print heads 3*a-c* can be attached to the rotation apparatus 7 at identical spacings from one another. As an alternative to this, the different print heads can also be attached to the rotation apparatus at non-identical spacings from one another, with the result that the entire system of rotation apparatus and print heads is balanced. Likewise as an alternative, a separate balancing weight 13 can be attached to the rotation apparatus.

Figure 3:
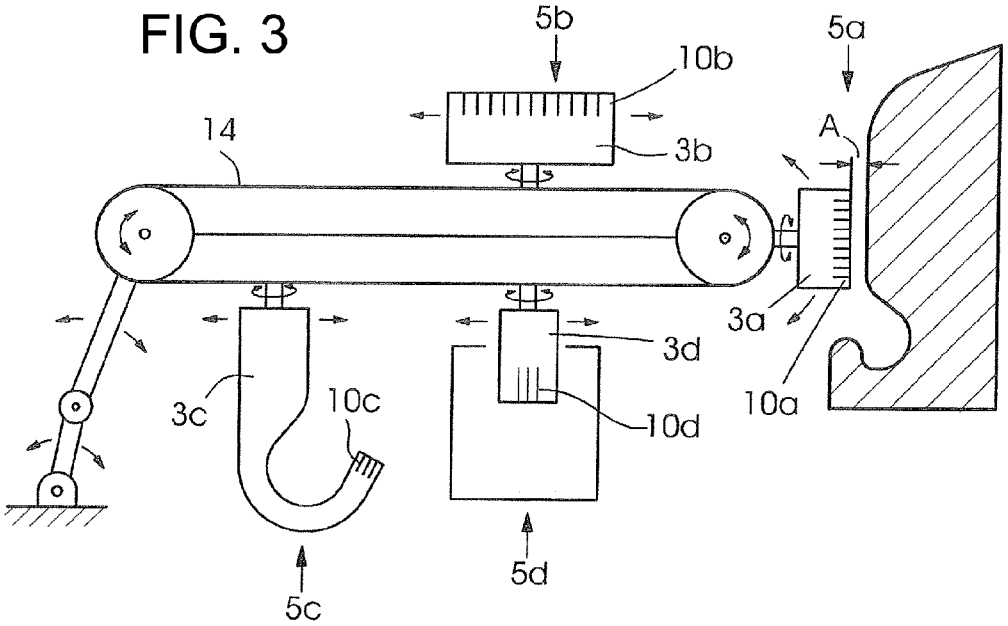
FIG. 3 is an enlarged, partly sectional, side-elevational view of a further preferred exemplary embodiment of an apparatus according to the invention for printing surfaces.

FIG. 3 shows a diagrammatic side view of a further preferred exemplary embodiment of an apparatus according to the invention for printing surfaces. Instead of the rotation apparatus which is shown in FIG. 1, a circulating belt 14 is then provided, on which diverse print heads 3*a-d* with different nozzle configurations 10*a-d* are disposed. The belt serves to move the print heads into respective positions 5*a-d*. The print head 3*a* is situated in a printing position 5*a*, and all of the other print heads 3*b-d* are situated in parking positions 5*b-d*, with the print head 3*d* at the same time assuming a cleaning position 5*d*. In the printing position, the active print head projects, for example, out of the row of inactive print heads and in this way can be moved without problems into the working spacing A from the surface 1.

The belt 14 or an apparatus including the belt and its guide rollers can in turn be disposed on a robot arm 6 or an X-Y-Z frame. As an alternative to the rotation apparatus or the belt apparatus, a linear drive can also be provided for moving the print heads 3*a-d*.

Figure 4A:
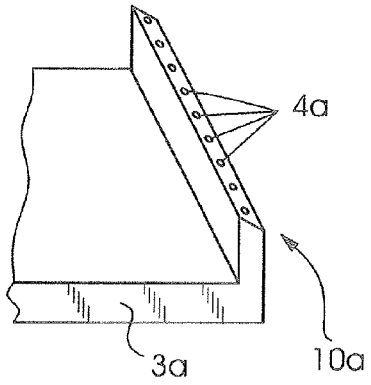
FIGS. 4A-4E are fragmentary, perspective views of preferred exemplary embodiments of apparatuses according to the invention.
Figure 4B:
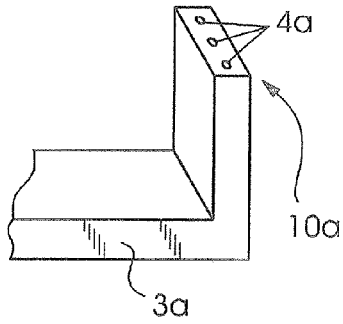
Figure 4C:
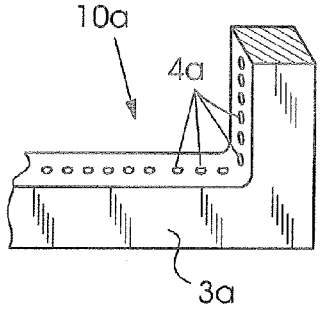
Figure 4D:
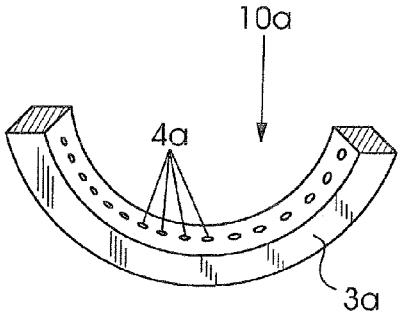
Figure 4E:
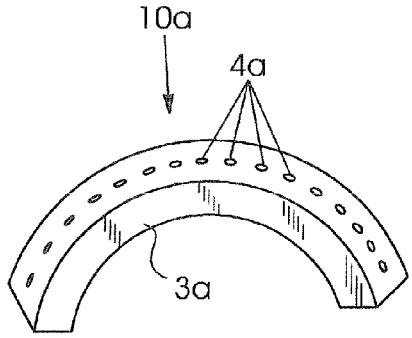

FIGS. 4A to 4E show diagrammatic perspective views of preferred exemplary embodiments of apparatuses according to the invention. It can be seen in FIG. 4A that the spatial configuration of the nozzles 4*a* of the nozzle configuration 10*a* of the print head 3*a* is linear and has a larger number of nozzles. FIG. 4B shows a similar print head 3*a* having a smaller number of nozzles 4*a*. As a result of their hook-shaped construction, both print heads 3*a* can be used for printing undercuts 11. FIG. 4C shows that the spatial configuration of the nozzles 4*a* of the nozzle configuration 10*a* can itself be hook-shaped, with the result that correspondingly shaped surfaces 1 can be printed. FIG. 4D shows a spatial configuration of the nozzles 4*a* of the nozzle configuration 10*a* in which the spatial configuration is constructed to have a curved shape, in particular a circular section shape. That nozzle configuration can be used for printing convex surfaces 1. FIG. 4E shows a spatial configuration of the nozzles 4*a* of the nozzle configuration in which the spatial configuration is likewise constructed to have a curved shape, in particular a circular section shape. However, that nozzle configuration can be used for printing concave surfaces 1. It can therefore be gathered from FIGS. 4A to 4E that the nozzle configurations 10*a* which are different from one another can differ in terms of their respective spatial configuration of the nozzles 4*a*.

The invention claimed is:

1. An apparatus for printing surfaces, the apparatus comprising:

at least one printing position and at least one parking position;

a plurality of movable print heads configured to be moved into said at least one printing position and into said at least one parking position;

each of said movable print heads having a plurality of individually actuable nozzles;

said movable print heads including at least one first print head and at least one second print head having mutually different nozzle configurations;

said at least one first print head being disposed in a printing position and said at least one second print head being disposed in a parking position, in a first mode; and said at least one first print head being disposed in a parking position and said at least one second print head being disposed in a printing position, in a second mode.

2. The apparatus according to claim 1, wherein said mutually different nozzle configurations have different numbers of nozzles, said number of nozzles of said nozzle configuration of said first print head being lower than said number of nozzles of said nozzle configuration of said second print head.

3. The apparatus according to claim 2, wherein said mutually different nozzle configurations have different spatial configurations of said nozzles.

4. The apparatus according to claim 3, wherein said spatial configuration of said nozzles of said nozzle configuration of at least one of said print heads is linear.

5. The apparatus according to claim 3, wherein said spatial configuration of said nozzles of said nozzle configuration of at least one of said print heads is hook-shaped.

6. The apparatus according to claim 3, wherein said spatial configuration of said nozzles of said nozzle configuration of at least one of said print heads is curved.

7. The apparatus according to claim 1, which further comprises a common transport apparatus on which said at least one first print head and said at least one second print head are disposed for moving said print heads into said positions.

8. The apparatus according to claim 7, wherein said common transport apparatus is a rotation apparatus or a transport apparatus having a circulating belt.

9. The apparatus according to claim 8, which further comprises a robot arm on which said common transport apparatus is disposed.

10. The apparatus according to claim 7, which further comprises a robot arm on which said common transport apparatus is disposed.

11. A system, comprising:

a robot arm; and an apparatus according to claim 1.

* * * * *